United States Patent [19]

Zedrosser et al.

[11] 4,369,593

[45] Jan. 25, 1983

[54] FIRING MECHANISM FOR PISTOLS

[75] Inventors: Ulrich Zedrosser; Satish K. Malhotra, both of Steyr, Austria

[73] Assignee: Steyr-Daimler-Puch Aktiengesellschaft, Vienna, Austria

[21] Appl. No.: 235,073

[22] Filed: Feb. 17, 1981

[30] Foreign Application Priority Data

Mar. 10, 1980 [AT] Austria ..... 1304/80

[51] Int. Cl.[3] ..... F41C 17/04

[52] U.S. Cl. ..... 42/70 F

[58] Field of Search ..... 42/70 F, 66

[56] References Cited

U.S. PATENT DOCUMENTS

| | | | |
|---|---|---|---|
| 961,189 | 6/1910 | Wesson | 42/66 |
| 4,021,955 | 5/1977 | Curtis | 42/70 F |
| 4,313,274 | 2/1982 | Ludwig et al. | 42/70 F |

FOREIGN PATENT DOCUMENTS 2528831 12/1976 Fed. Rep. of Germany .

*Primary Examiner*—Charles T. Jordan
*Assistant Examiner*—Teddi L. Parr
*Attorney, Agent, or Firm*—Kurt Kelman

[57] ABSTRACT

A firing mechanism for a pistol comprises a firing pin, a hammer for striking on the firing pin, a hammer spring biasing the hammer, and a catch lever for temporarily locking the hammer in a cocked position is designed to have a safety function. In order to provide a structurally simple mechanism which provides perfect safety against an unintended discharge of a shot without need for additional parts, the catch lever is provided with two locking surfaces. When the hammer is uncocked, the firing pin bears on one of said locking surfaces in the firing direction and the hammer bears on the other of said locking surfaces in the striking sense.

6 Claims, 3 Drawing Figures

FIRING MECHANISM FOR PISTOLS

Figure 1:
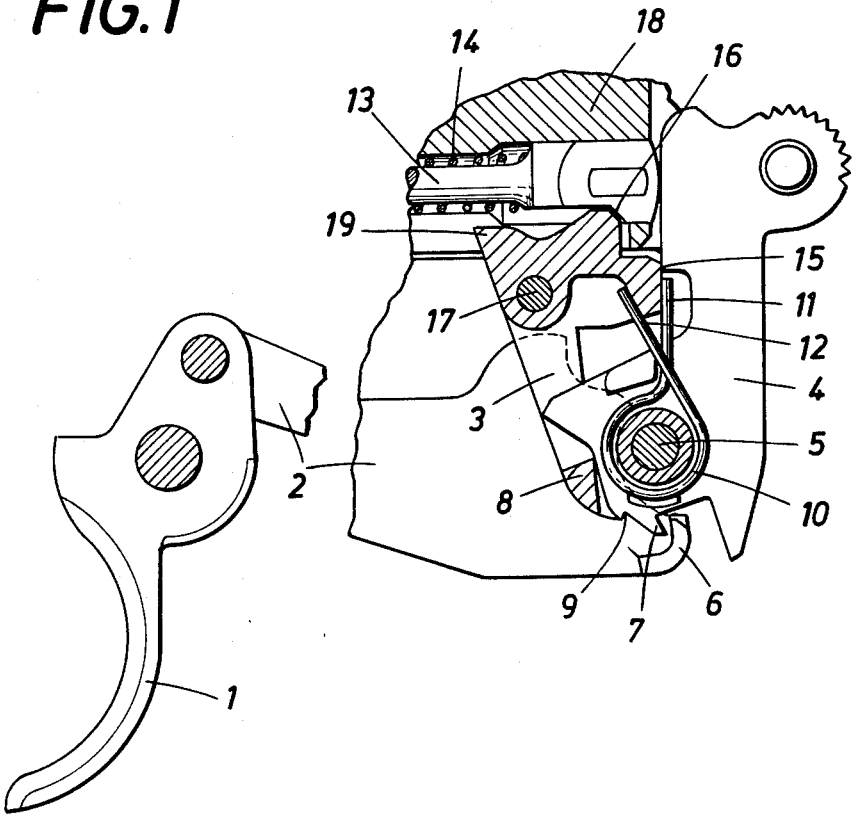

This invention relates to a firing mechanism for a pistol, comprising a firing pin, a hammer for striking on the firing pin, a hammer spring biasing the hammer, and a catch lever for locking the hammer, which firing mechanism has a safety function.

German Patent Publication No. 25 28 831 discloses a safety comprising a spring-loaded locking member which is movable substantially transversely to the axial direction of the firing pin and in locking position enters an opening in the firing pin, and an unlocking member, which is adapted to be actuated by the trigger to move the locking member to a position in which it unlocks the firing pin. Such safeties are quite reliable when the arm is handled in the normal manner. But they cannot prevent an unintended discharge of a shot when the pistol falls from a certain height on a hard surface in such a direction that a component of force is exerted which moves the locking member by inertia out of engagement with the firing pin. In order to ensure an absolute safeguarding in such case too, a second spring-loaded locking member is associated with the firing pin and in position of rest is disengaged from the firing pin but in response to forces which tend to cause a release of the firing pin by the first locking member is moved by inertia into a second opening of the firing pin and thus locks the latter. This arrangement has the disadvantage that the two locking members, which are biased by small springs, increase the structural expenditure, and that a locking member may remain in its disengaged position owing to the presence of foreign matter. This cannot be detected by the user of the pistol so that shooting with the pistol is then possible and the danger of an accident is increased. Besides, a catch notch is required to lock the cock in its relaxed position so that the hammer cannot strike on the firing pin unless the trigger is pulled. But when the pistol falls on the side which is at the rear of the hammer, the lever ratio will be so high that the resulting force can damage the locking surface so that a shot can be discharged unintendedly.

It is an object of the invention to provide a hammer mechanism which is of the kind described first hereinbefore and which ensures perfect safety whereas it is structurally simple and does not require additional parts.

This object is accomplished according to the invention in that the catch lever has two locking surfaces, and the firing pin and the hammer are arranged to bear on respective ones of said abutment surfaces in the firing direction and striking sense, respectively, when the hammer is in its uncocked position.

In this mechanism, the locking member for locking the firing pin is constituted by the catch lever, which constitutes also the locking member for the hammer. This concept results in a simple structure and does not require additional parts. The locking surface for engagement by the hammer is near the point where the hammer strikes on the firing pin. This arrangement results in a much more favorable leverage and there is no need to take up very strong forces when the pistol is subjected to an impact on the rear of the hammer. If owing to foreign matter the catch lever is held in a position in which the locking surfaces cannot be effective, this will prevent also the discharge of a shot and will thus indicate to the user of the pistol that the latter is not in order.

According to a preferred further feature of the invention the normals on the locking surfaces extend approximately through the pivotal axis of the catch lever so that the latter will be substantially free from any torque.

If the hammer is biased by a convoluted spring subjected to bending, such spring will be provided with arms which tend to move toward each other and which bear on the hammer and the catch lever, respectively. When the hammer is in its uncocked position, that arm of the spring which is associated with the hammer will engage the locking surface for supporting the hammer. This arrangement will ensure that the hammer mechanism will automatically assume the required locking position as the hammer is uncocked.

The catch lever is suitably provided with a nose, which is designed to eject the cartridge. This feature will further simplify the structure because it eliminates the need of a separate member otherwise required.

Figure 2:
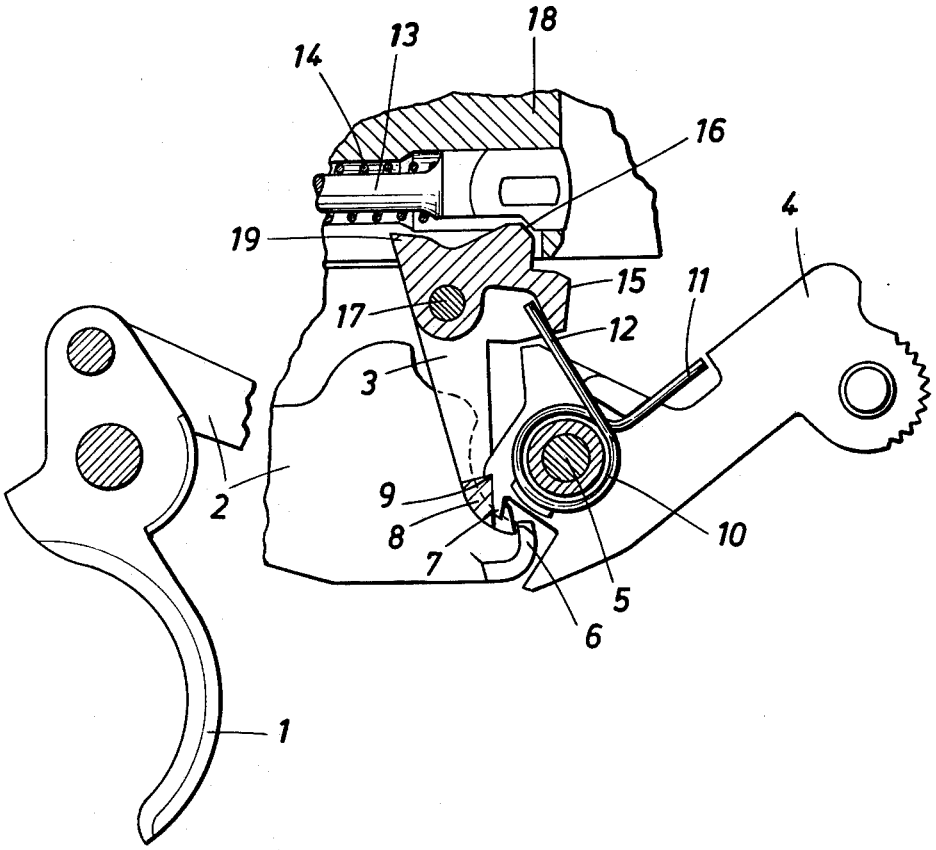
Figure 3:
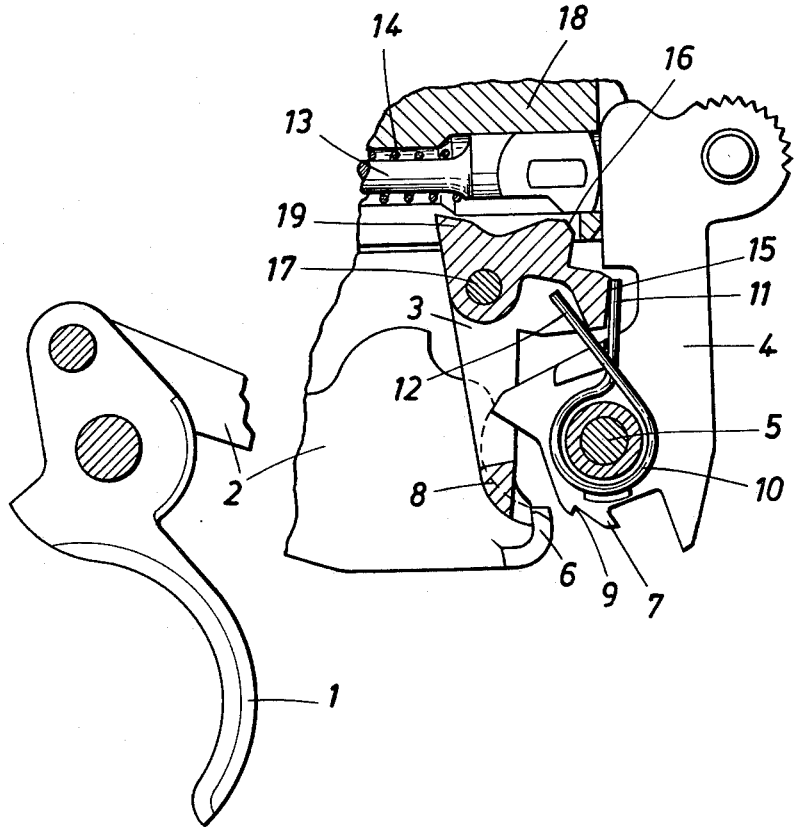

An embodiment of the invention is shown by way of example on the drawings, in which:

FIG. 1 show the essential parts of a hammer mechanism in an uncocked and locked position, FIG. 2 shows the mechanism before a shot is discharged and FIG. 3 shows the mechanism during the discharge of a shot.

The trigger 1 is connected to a trigger bar 2, which is enlarged in width at the rear and acts on the catch lever 3. A hammer 4 is pivoted on a pivot 5. When the trigger 1 is pulled, a lug 6 of the trigger bar 2 will engage a nose 7 of the hammer 4 so that the latter is pivotally moved until the nose 8 of the catch lever 3 can fall into the notch 9 of the hammer 4, as is shown in FIG. 2. The hammer is biased by a convoluted spring 10, which is subjected to bending and has two arms 11, 12 urged by said spring toward each other. In the position shown in FIG. 2, the arm 11 bears on the cock 4 and the other arm 12 on the catch lever 3. When the nose 8 has left the notch 9, the hammer 4 strikes on the firing pin 13, which cooperates with a return spring 14.

It is apparent from FIG. 1 that the catch lever 3 has two locking surfaces 15, 16. When the hammer is in its uncocked position, the firing pin 13 bears on the locking surface 16 and the hammer 4 bears on the other locking surface 15. The locking surfaces 15, 16 are so arranged that the normals on them extend adjacent to the pivotal axis (pivot 17) for the catch lever 3 so that the catch lever 3 will not be subjected to any substantial torque in response to an impact applied to the pistol on the rear of the hammer 4. It will be understood that when the hammer is uncocked the distance from the striking surface of the hammer 4 to the rear end face of the breech member 18 is less than the distance from the tip of the retracted firing pin to the base of the cartridge case. The catch lever 3 has a nose 19, which is adapted to eject the cartridge case.

We claim:

1. In a firing mechanism for a pistol, comprising a pivoted hammer, which is pivotally movable in a cocking sense from an uncocked position to a cocked position and in a striking sense from said cocked position to said uncocked position, a hammer spring urging said hammer in said striking sense, a firing pin which is axially movable between a retracted position and a firing position, said hammer when urged by said spring from said cocked position to said uncocked position being arranged to strike on said firing pin when it is in said retracted position and to cause said firing pin to move to said firing position, and a catch lever, which is pivotally movable between a position of rest and an actuated position and when in said actuated position is arranged to engage said hammer in said cocked position so as to hold said hammer in said cocked position, said catch lever being adapted to release said hammer for a movement in said striking sense, the improvement residing in that said catch lever has first and second locking surfaces, said first locking surface is arranged to engage said hammer and to prevent a movement of said hammer in said striking sense when said hammer is in said uncocked position and said catch lever is in said position of rest, and said second locking surface is arranged to engage said firing pin and to prevent a movement of said firing pin toward said firing position when said hammer is in said uncocked position, said firing pin is in said retracted position, and said catch lever is in said position of rest.

2. The improvement set forth in claim 1, wherein resilient means are provided tending to move said firing pin to said retracted position, also means operable to move said hammer to said cocked position and said catch lever to said actuated position and to cause said hammer to be released for a movement in said striking sense from said cocked position.

3. The improvement set forth in claim 1, wherein pivot means are provided which define a pivotal axis for said catch lever and said first and second locking surfaces are so arranged that the normals on them extend adjacent to said pivotal axis.

4. The improvement set forth in claim 1, wherein said hammer spring consists of a convoluted spring subjected to bending and has first and second arms, which are urged by said spring toward each other and bear on said hammer and catch lever, respectively.

5. The improvement set forth in claim 4, wherein said first arm is arranged to engage said first locking surface when said hammer is in said uncocked position.

6. The improvement set forth in claim 1, wherein said catch lever has a nose to eject a cartridge case.

* * * * *